United States Patent [19]

Deveney

[11] 4,129,024

[45] Dec. 12, 1978

[54] METHOD AND APPARATUS FOR FORMING ELONGATED, TAPERED WALL SHELLS

[75] Inventor: Charles H. Deveney, Lower Burrell, Pa.

[73] Assignee: Aluminum Company of America, Pittsburgh, Pa.

[21] Appl. No.: 849,996

[22] Filed: Nov. 9, 1977

[51] Int. Cl.[2] ..... B21D 51/54

[52] U.S. Cl. ..... 72/329; 72/347; 72/467

[58] Field of Search ..... 29/1.3; 72/329, 336, 72/347, 467

[56] References Cited

U.S. PATENT DOCUMENTS

| | | | |
|---|---|---|---|
| 2,329,173 | 9/1943 | Fife | 72/467 |
| 2,379,450 | 7/1945 | Musser | 72/336 |
| 2,415,940 | 2/1947 | Eckstein | 72/329 |
| 2,490,926 | 12/1949 | Slater | 72/336 |

*Primary Examiner*—Lowell A. Larson
*Attorney, Agent, or Firm*—Andrew Alexander

[57] ABSTRACT

Elongated, thin wall shells are formed from substantially circular blanks cut from sheet material by steps including providing a blank in a blank holder on a die having an effective entrance and exit aperture, the entrance aperture having an extent substantially commensurate in size with the size of the blank to be drawn, the die having a cavity, the wall of which converges inwardly from the entrance aperture to the effective exit aperture. The wall connecting the entrance and exit apertures is defined by an arc of a sector of a circle, the sector having an angle in the range of 12° to 34°. The thin wall shell is formed by displacing the blank through the die by action of a punch.

12 Claims, 4 Drawing Figures

METHOD AND APPARATUS FOR FORMING ELONGATED, TAPERED WALL SHELLS

INTRODUCTION

This invention relates to elongated, thin wall shells and, more particularly, to a method and apparatus for forming elongated, tapered wall shells useful in the fabrication of cartridge cases and the like.

In the prior art, generally the fabrication of tapered wall shells, such as those used for forming into cartridge cases, has required a series of steps or has required complicated machines which permit the fabrication of the shell in a single operation. U.S. Pat. No. 3,984,259 and U.S. Pat. No. 3,498,221 illustrate a typical series of steps used to form the tapered wall shell and a cartridge case therefrom. U.S. Pat. No. 3,977,225 discloses a method of forming a tapered wall shell in a single continuous operation. However, this patent requires triaxial forces, e.g. use of a cushion, to ensure ductility and to control flow of metal in the blank.

The present invention includes a method and apparatus for producing blanks and forming elongated, thin walled shells having relatively thick integral ends thereon.

SUMMARY OF THE INVENTION

An object of the present invention is to provide a method and apparatus for forming thin walled shells.

Another object of this invention is to provide a method and apparatus for making thin walled shells in a single continuous operation.

Yet another object of this invention is to provide a method and apparatus for making blanks and forming shaped articles therefrom.

These and other objects will become apparent from the drawing, specification and claims attached hereto.

Elongated, thin wall shells are formed from blanks cut or punched from sheet material by steps including providing a blank in a blank holder on a die having effective entrance and exit apertures, the entrance aperture having an extent substantially commensurate in size with the size of the blank, the die having a cavity, the wall of which cavity converges inwardly from the entrance to the exit aperture. The wall connecting the entrance and exit apertures is defined by an arc of a sector in a circle, the sector having an angle in the range of 12° to 34°. The thin walled shell is formed by displacing the blank through the die by action of a punch.

DETAILED DESCRIPTION OF THE PREFERRED EMBODIMENTS

Figure 1:
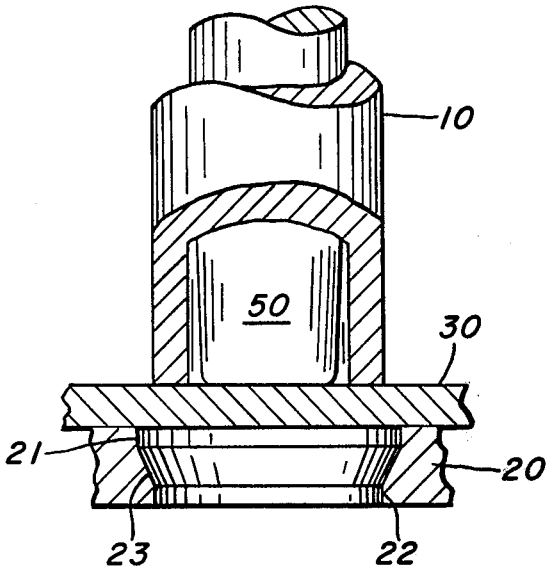
FIG. 1 is a simplified diagrammatic view, partially in cross section, including a cylindrical blanking punch and die assembly with sheet material therebetween in accordance with one embodiment of the invention.

Referring now more specifically to FIG. 1, there is shown a novel combination of blanking punch and die assembly generally referred to as 10 and 20, respectively. A workpiece 30, e.g. sheet material, is shown between blanking punch 10 and die 20. For purposes of illustration, blanking punch 10 and die 20 are shown as substantially circular in cross section. Blanking die 20 has an entrance aperture 21 and an exit aperture 22 and an inwardly converging transition zone 23 extending from entrance aperture 21 to exit aperture 22. Preferably, transition zone 23 is substantially conical in shape as depicted in FIG. 1. Blanking punch 10 can be substantially cylindrical and can accommodate a punch 50 which in cooperation with a die (not shown in FIG. 1) can form a blank into a cup shaped article in one continuous operation.

Blanking die 20 has aperture 21 axially aligned with blanking punch 10 substantially as shown in FIG. 1. Entrance aperture 21 has an effective extent larger than the cross-sectional area of blanking punch 10. When the blanking punch and die are circular, preferably, aperture 21 has a radius 15 to 25% of the sheet material 30 greater than the radius of blanking punch 10. In addition, typically exit aperture 22 of die 20 has an extent greater than the cross-sectional area of the blanking punch, depending largely on the thickness of workpiece 30. For an entrance aperture having a diameter of 3.235 inches and a sheet thickness of 0.625 inch, typically exit aperture 22 would have a diameter of about 3.231 inches.

Figure 2:
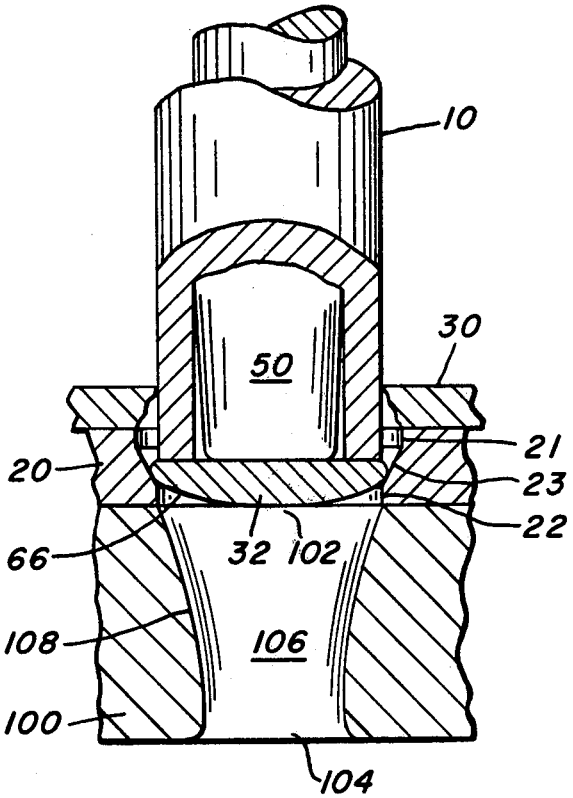
FIG. 2 is a view similar to that shown in FIG. 1 showing a blank cut from the sheet material in accordance with the invention.

By effective extent it is meant that entrance aperture 21 is such that upon displacing blanking punch 10 linearly towards blanking die 20, blank 32 is cut or sheared from workpiece 30, FIG. 2. The blank has a slightly curved configuration. It will be understood that the curved configuration is obtained by providing the clearance between blanking punch and blanking die, as noted hereinabove. Further, it will be understood that in conventional blanking punch and die assemblies, the clearance is less than those set forth above and typically have a difference of about 8% of the sheet material.

If blank 32 is cut from the workpiece by a conventional blanking punch and die assembly, the sheared edge often exhibits what is referred to as secondary fractures. Secondary fractures often result in laps in the wall of the formed article, e.g. utensils, cartridge cases and the like, during the draw and ironing operation and, of course, must be avoided since they provide weak areas in the wall. However, when the blank is cut from the workpiece in accordance with the present invention, the sheared edge is substantially free of secondary fractures.

In addition to providing a blank which is curved, the blanking punch and die of the present invention cooperate to cut or shear blank 32 from sheet 30 in a way which results in blank top 64 having a dimension commensurate in size with the size of blanking punch 10 and blank bottom 66 having a dimension commensurate in size with the extent of entrance aperture 21. It is believed that shearing the blank from the workpiece in this way aids in ensuring the absence of secondary fractures and the resulting formation of laps in the subsequent forming operations.

It should be understood that in a conventional blanking die, the blank tends to shoot ahead of the blanking punch on being sheared or cut from the workpiece. When the blank is permitted to move ahead of the blanking punch, it can become misaligned in the die for the next step, e.g. draw and ironing die, resulting in the formation of a nonsymmetrical cup shaped article. However, by providing transition zone 23 in the blanking die in accordance with the principles of the present invention, the motion of the blank, upon being sheared from the workpiece, is restricted thereby ensuring that the blank remains in contact with the blanking punch and that it does not become misaligned with respect to positioning thereof for the next forming operation.

Figure 3:
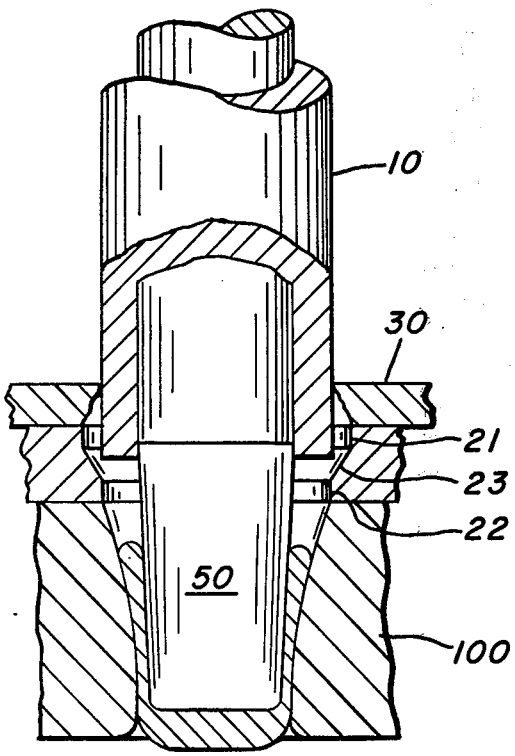
FIG. 3 is a view similar to that shown in FIG. 2 showing a partially formed shell.
Figure 4:
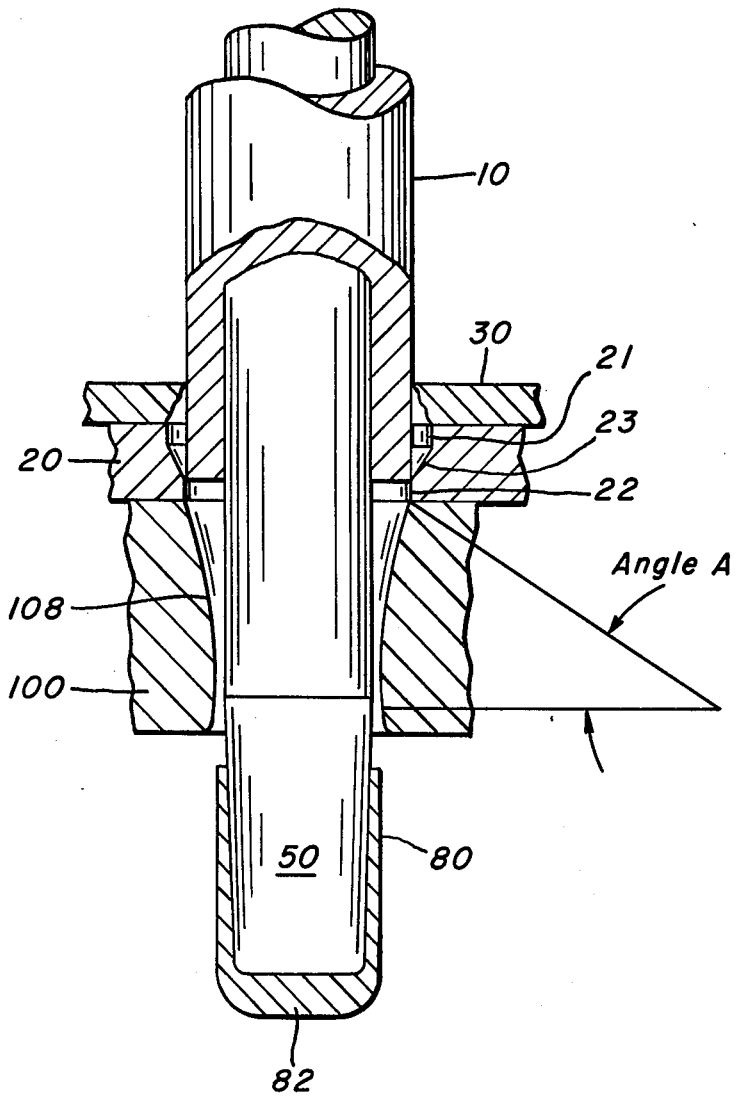
FIG. 4 shows a tapered wall shell formed by a punch and die in accordance with the present invention.

Another aspect of the present invention includes the formation of elongated, thin walled shells such as tapered wall shells 80, FIG. 4. That is, the present invention includes a blanking operation substantially as described above and the formation of the elongated, tapered wall shell in one continuous operation. The shells can have a tapered wall or a substantially uniformly thick wall depending on the shape of the punch used. If the shells have a tapered wall for forming into catrtidge cases, a typical thickness at the mouth of the shell for a 30 mm cartridge would be about 0.03 inch. Similarly for a 20 mm cartridge, the shell would have a thickness of about 0.02 inch at its mouth. It will be appreciated that formation of the shell in one continuous operation eliminates many steps including preforming and cupping operations thereby permitting the formation of cartridge cases, for example, in a highly economical manner. FIGS. 2, 3 and 4 depict combination draw and ironing die 100 and tapered punch 50 used in forming the elongated, tapered wall shell. It will be seen from an inspection of FIGS. 2, 3 and 4 that the blanking die exit aperture 22 can be used as a blank holder for draw and ironing die 100.

Draw and ironing is used herein in its ordinary sense. That is, the term draw refers to an operation where a flat blank is turned upwardly at its peripheral margin and simultaneously smoothed by use of a punch and die to form a cup shaped article. The term ironing refers to an operation wherein the wall of the cup shaped article is elongated by reducing the thickness of the wall and without appreciable reduction in the diameter of the cup shaped article. It will be noted that in drawing, the wall of the cup shaped article is also elongated but the diameter of the cup is reduced. By reference to "combination draw and ironing", it is meant that a large part of the drawing operation and the ironing operation take place substantially simultaneously in die 100.

Combination draw and ironing die 100 also has an entrance aperture 102, an exit aperture 104 and a die cavity 106 defined by wall 108. From FIG. 2 it will be noted that entrance aperture 102 has an effective extent substantially commensurate in size with the size of blank 32. Also, it will be noted that wall 108 defining die cavity 106 converges inwardly and connects entrance aperture 102 and exit aperture 104. Wall 108 of die cavity 106 has a contoured shape which, along with tapered punch 50 permits the formation of elongated tapered wall shell 80 from blank 32 in one continuous operation. Wall 108 is defined by an arc of a sector of a circle, the arc passing from entrance aperture 102 to exit aperture 104. The sector has an angle in the range of 12° to 34° and preferably the circle of which the sector is a part has a center located in substantially the same plane as effective exit aperture 104. It should be noted that exit aperture 104 also has an effective extent which controls the outside dimensions of the elongated tapered wall shell. The cross-sectional configuration of tapered punch 50 controls the inside dimensions of the shell. In addition, the amount of taper in the wall of the shell is controlled by the taper of the punch.

In the present invention, the diameter of blank 32 and therefore the extent of entrance aperture 102 of die 100 is determined largely by the height of the tapered wall shell. That is, because the amount or volume of material in head 82 of the shell 80 is constant for a particular size of exit aperture 104, additional material in the blank is utilized in producing longer or higher walls on the shells. Thus, the extent or size of entrance aperture 102 is fixed in this way. Also, the size of the exit aperture is fixed by the outside diameter of the tapered wall shell which in the instance of cartridge cases would depend on the caliber desired. Thus, entrance aperture 102 and exit aperture 104 are determined and can be connected by the arc of a sector of a circle whose center should be in substantially the same plane as exit aperture 104 (FIG. 4). The sector has a preferred angle in the range of 18° to 26°. With respect to the thickness of the blank, it is determined largely by thickness desired in head 82 of the tapered wall shell. Head 82 has a thickness substantially the same as the starting blank in most cases. However, in some instances, the thickness of head 82 can be slightly thicker than the blank.

When it is desired to fabricate cartridge cases, the tapered wall shell formed as above may be subject to additional operations including trimming, providing a head, pocket, vent and extractor groove.

The present invention is highly advantageous in that by use of the novel blanking punch and die assembly blanks can be cut or sheared from sheet material which blanks, by virtue of the blanking die, are positioned symmetrically in a highly consistent basis for forming into shaped articles in subsequent steps. In addition, the present invention is advantageous in that blanking and forming of elongated tapered wall shells can be performed in one continuous operation in a double action press.

By use of the apparatus described, tapered wall, elongated cylindrical shells were produced from aluminum alloys 7475 and 5454 and from brass and mild steel. The brass had a composition of 70 wt.% copper and 30 wt.% zinc. The metal blanks and the tapered wall shell were produced in a single continuous action. The blanks, which were cut from sheet and used for aluminum and brass shells, had a diameter of 0.900 inch and a thickness of 0.200 inch. The elongated, tapered wall shells made from aluminum and brass had a wall thickness at the mouth of the shell of 0.022 inch. The shells had a length of about 1.40 inch and an outside diameter of 0.550 inch, providing a length to diameter ratio of 2.55:1. The angle of the arc sector for the combination draw-ironing die was 22°. It was found that the mild steel was much more difficult to form into tapered wall shells because of the relatively high yield strength. However, using steel sheet having a thickness of 0.115 inch, a tapered wall shell having a length of about 0.85 inch was produced. It will be understood that a steel blank having a greater thickness as well as a larger blank diameter can be used in order to form a deeper shell. However, in the case of higher yield strength steel, higher press tonnage is required.

While the invention has been described in terms of preferred embodiments, the claims appended hereto are intended to encompass other embodiments which fall within the spirit of the invention.

What is claimed is:

1. A method of forming an elongated, unitary shell having a thin side wall and relatively thick end integral therewith, the shell formed from a substantially circular blank cut from sheet material, the method comprising the steps of:

(a) providing a blank in a blank holder on a die having an effective entrance aperture and an effective exit aperture, the entrance aperture having an extent substantially commensurate in size with the size of the blank to be drawn, said die having a cavity, the walls of which converge inwardly from said entrance aperture to said effective exit aperture, said wall defined by an arc of a sector of a circle, said arc passing from the entrance aperture to the exit aperture, said sector having an angle in the range of 12° to 34°, said circle having its center located in substantially the same plane as said effective exit aperture; and (b) displacing said blank through said die by action of a punch to form said shell.

2. The method according to claim 1 wherein the sheet material employed is metal.

3. The method according to claim 1 wherein the sector of the circle has an angle in the range of 18° to 26°.

4. The method according to claim 1 wherein the elongated shell has a tapered wall.

5. The method according to claim 1 wherein the end of the shell has a thickness substantially the same as the thickness of the blank.

6. A method of forming elongated, unitary shell having a thin wall and a relatively thick end, the shell formed from sheet material, the method comprising the steps of:

(a) supporting the sheet material on a blanking die having a substantially circular entrance aperture, an exit aperture and an inwardly converging transition zone extending from the entrance aperture to the exit aperture;

(b) punching a blank from the sheet material using a cylindrical blanking punch axially aligned with said blanking die and having a cross-sectional area less than the cross-sectional area of the entrance aperture, the punching being effected by displacing the blanking punch into the entrance aperture, the transition zone controlling the motion of the blank on shearing from the sheet material and permitting the blanking punch to maintain engagement with the blank as it is moved through the blanking die to the exit aperture;

(c) providing a combination draw and ironing die in axial alignment with the exit aperture of the blanking die to receive the blank therefrom, the draw and ironing die having an effective entrance aperture and an effective exit aperture, the draw and ironing die entrance aperture having an extent substantially commensurate in size with the size of the blank to be drawn and having a cavity, the walls of which converge inwardly from draw and ironing die entrance aperture to the effective exit aperture, said wall defined by an arc of a sector of a circle, said arc passing from the entrance aperture to the exit aperture, said sector having an angle in the range of 12° to 34°, said circle having its center located in substantially the same plane as said effective exit aperture; and (d) displacing said blank through the combination draw and forming die by action of a punch to form said thin walled shell.

7. The method according to claim 6 wherein the sector of the circle has an angle in the range of 18° to 26°.

8. The method according to claim 6 wherein the shell has a tapered wall and an end which has a thickness substantially the same as the thickness of the blank.

9. The method according to claim 6 wherein the blanking die aperture has a radius 15 to 25% of the sheet material greater than the radius of the blanking punch.

10. The method according to claim 6 wherein the blank cut from the sheet material by the blanking punch and die is substantially free of secondary fractures.

11. In the method of forming a cartridge case from an elongated, unitary shell having a thin side wall and a relatively thick end integral therewith, the shell formed from a substantially circular blank, the steps comprising:

(a) providing a blank in a blank holder on a die having an effective entrance aperture and an effective exit aperture, the entrance aperture having an extent substantially commensurate in size with the size of the blank to be drawn, said die having a cavity, the walls of which converge inwardly from said entrance aperture to said effective exit aperture, said wall defined by an arc of a sector of a circle, said arc passing from the entrance aperture to the exit aperture, said sector having an angle in the range of 12° to 34°, said circle having its center located in substantially the same plane as said effective exit aperture; and (b) displacing said blank through said die by action of a punch to form said shell.

12. In the method of forming a cartridge case from an elongated, tapered wall shell having a relatively thick end integral therewith, the shell formed from a substantially circular blank cut from sheet material, the steps comprising:

(a) supporting the sheet material on a blanking die having a substantially circular entrance aperture, an exit aperture and an inwardly converging transition zone extending from the entrance aperture to the exit aperture;

(b) punching a blank from the sheet material using a cylindrical blanking punch axially aligned with said blanking die and having a cross-sectional area less than the cross-sectional area of the entrance aperture, the punching being effected by displacing the blanking punch into the entrance aperture, the transition zone controlling the motion of the blank on shearing from the sheet material and permitting the blanking punch to maintain engagement with the blank as it is moved through the blanking die to the exit aperture;

(c) providing a combination draw and ironing die in axial alignment with the exit aperture of the blanking die to receive the blank therefrom, the draw and ironing die having an effective entrance aperture and an effective exit aperture, the draw and ironing die entrance aperture having an extent substantially commensurate in size with the size of the blank to be drawn and having a cavity, the walls of which converge inwardly from draw and ironing die entrance aperture to the effective exit aperture, said wall defined by an arc of a sector of a circle, said arc passing from the entrance aperture to the exit aperture, said sector having an angle in the range of 12° to 34°, said circle having its center located in substantially the same plane as said effective exit aperture; and (d) displacing said blank through the combination draw and forming die by action of a punch to form said thin walled shell.

* * * * *